US012104342B2

(12) United States Patent
Regler

(10) Patent No.: US 12,104,342 B2
(45) Date of Patent: Oct. 1, 2024

(54) METHOD AND SYSTEM FOR PRODUCING A FOUNDATION ELEMENT IN THE GROUND

(71) Applicant: BAUER Spezialtiefbau GmbH, Schrobenhausen (DE)

(72) Inventor: Hans Regler, Schrobenhausen (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 481 days.

(21) Appl. No.: 16/976,033

(22) PCT Filed: Jan. 17, 2019

(86) PCT No.: PCT/EP2019/051171
§ 371 (c)(1),
(2) Date: Aug. 26, 2020

(87) PCT Pub. No.: WO2019/166153
PCT Pub. Date: Sep. 6, 2019

(65) Prior Publication Data

US 2020/0400016 A1 Dec. 24, 2020

(30) Foreign Application Priority Data

Mar. 1, 2018 (EP) ..... 18159364

(51) Int. Cl.
*E02D 7/22* (2006.01)
*E02D 1/02* (2006.01)
*E02D 5/22* (2006.01)

(52) U.S. Cl.
CPC . *E02D 1/02* (2013.01); *E02D 5/22* (2013.01)

(58) Field of Classification Search
CPC .... E02D 1/02; E02D 5/22; E02D 7/22; E02D 17/13; E02D 5/66; E02D 7/18;
(Continued)

(56) References Cited

U.S. PATENT DOCUMENTS 3,720,063 A * 3/1973 Shono ..... E02D 3/106 405/50
3,772,892 A * 11/1973 Ogawa ..... E02D 3/106 405/271

(Continued)

FOREIGN PATENT DOCUMENTS

CN 101761328 A 6/2010
EP 1016759 A1 7/2000

(Continued)

OTHER PUBLICATIONS

An Office Action mailed by China National Intellectual Property Administration on Sep. 3, 2021, which corresponds to Chinese Patent Application No. 201980016606.5 and is related to U.S. Appl. No. 16/976,033 with English language translation.

(Continued)

*Primary Examiner* — Edwin J Toledo-Duran
(74) *Attorney, Agent, or Firm* — Studebaker & Brackett PC

(57) ABSTRACT

The invention relates to a method and a system for producing a foundation element in the ground by means of a construction apparatus, wherein by means of a ground working tool a hole is formed in the ground, in which the foundation element is produced, wherein by means of a control and evaluation unit at least one operating variable of the construction apparatus, which changes depending on a ground composition, is detected as a function of a working depth. According to the invention provision is made in that in the control and evaluation unit a ground profile to be expected is entered, which indicates a layer structure of the ground with ground layers of different ground composition, and in that by the control and evaluation unit the detected, at least one operating variable is set in correlation with the stated ground profile in order to establish, at which working (Continued)

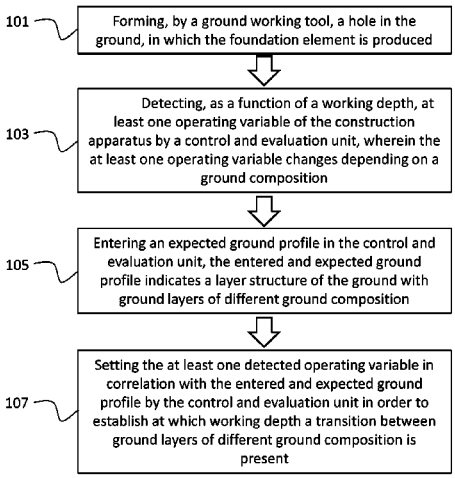

depth a transition between ground layers of different ground composition is present.

14 Claims, 1 Drawing Sheet

(58) Field of Classification Search
CPC ..... E02D 1/025; E02D 3/08; E02D 3/054; E02D 5/34; E02D 5/38; E02D 1/022
See application file for complete search history.

(56) References Cited

U.S. PATENT DOCUMENTS 3,906,781 A * 9/1975 Vlasblom ..... G01N 33/24 73/84
4,594,899 A * 6/1986 Henke ..... E02D 1/022 73/152.59
5,109,702 A * 5/1992 Charlie ..... E02D 1/02 73/84
5,177,415 A * 1/1993 Quibel ..... E01C 19/288 318/128
5,441,366 A * 8/1995 Esters ..... E02D 31/008 405/130
5,663,649 A * 9/1997 Topp ..... G01R 27/2676 324/643
5,704,142 A * 1/1998 Stump ..... E02F 5/06 701/50
5,771,985 A * 6/1998 Jaworski ..... E21B 7/24 173/49
5,797,705 A * 8/1998 Kellner ..... E02D 5/385 405/253
6,588,987 B1 * 7/2003 Degen ..... E02D 3/054 405/271
6,742,555 B2 * 6/2004 Degen ..... E02D 15/06 405/232
6,983,643 B2 * 1/2006 Brighton ..... G01N 3/24 73/84
8,139,108 B2 * 3/2012 Stratton ..... G05D 1/0044 348/121
8,849,523 B1 * 9/2014 Chan ..... A01G 25/167 701/50
10,712,330 B2 * 7/2020 Long ..... E21C 41/31
2002/0005297 A1 * 1/2002 Alft ..... E21B 7/28 175/45
2006/0241838 A1 * 10/2006 Mongiardo ..... B60K 35/00 701/50
2006/0287792 A1 * 12/2006 Jarrett ..... A01B 79/005 701/50
2007/0214687 A1 * 9/2007 Woon ..... E02F 3/842 701/50
2007/0219693 A1 * 9/2007 Stratton ..... E02F 3/844 701/50
2007/0239337 A1 * 10/2007 Anderson ..... A01B 79/005 701/50
2007/0288147 A1 * 12/2007 Reeves ..... A01D 41/1217 701/50
2011/0166843 A1 * 7/2011 Hsu ..... G06F 30/20 702/11
2012/0136508 A1 * 5/2012 Taylor ..... E02F 9/262 701/25
2014/0180547 A1 * 6/2014 Edara ..... E02F 9/262 701/50
2014/0180548 A1 * 6/2014 Edara ..... E02F 9/261 701/50
2014/0219726 A1 * 8/2014 Degen ..... E02D 5/66 405/232
2014/0277957 A1 * 9/2014 Clar ..... E02F 5/32 701/50
2015/0004572 A1 * 1/2015 Bomer ..... G09B 9/042 434/219
2016/0076223 A1 * 3/2016 Wei ..... G05D 1/021 701/50
2016/0077513 A1 * 3/2016 Wei ..... E01C 19/004 700/114
2017/0059544 A1 * 3/2017 Stafford ..... C10G 1/045
2017/0090068 A1 * 3/2017 Xiang ..... G01N 33/24
2017/0268874 A1 * 9/2017 Kasahara ..... G01L 19/00
2018/0210454 A1 * 7/2018 Ready-Campbell ..... G05D 1/0219
2019/0033441 A1 * 1/2019 Gonzáles Valdés .... G01S 7/003
2019/0064362 A1 * 2/2019 Scott ..... G01S 13/865
2020/0393595 A1 * 12/2020 Lee ..... G01V 20/00
2021/0235609 A1 * 8/2021 Ferrari ..... G01S 13/885
2021/0309352 A1 * 10/2021 Elkins ..... G06V 20/10
2024/0054577 A1 * 2/2024 Bauer ..... G06Q 50/08

FOREIGN PATENT DOCUMENTS

EP 1942247 B1 4/2009
JP S62-291392 A 12/1987
JP 2000-019261 A 1/2000
JP 2000-160550 A 6/2000
JP 2011-038257 A 2/2011
JP 2014-152473 A 8/2014
KR 10-1999-0004214 A 1/1999
KR 10-2008-0072773 A 8/2008
WO 2012/171527 A2 12/2012

OTHER PUBLICATIONS

International Search Report issued in PCT/EP2019/051171; mailed May 9, 2019.
"Notice of Reasons for Refusal" Office Action issued in JP 2020-545728; mailed by the Japanese Patent Office on Jun. 21, 2022.
An Office Action mailed by the Korean Intellectual Property Office on Jun. 28, 2023, which corresponds to Korean Patent Application No. 10-2020-7027467 and is related to U.S. Appl. No. 16/976,033; with English language translation.

* cited by examiner

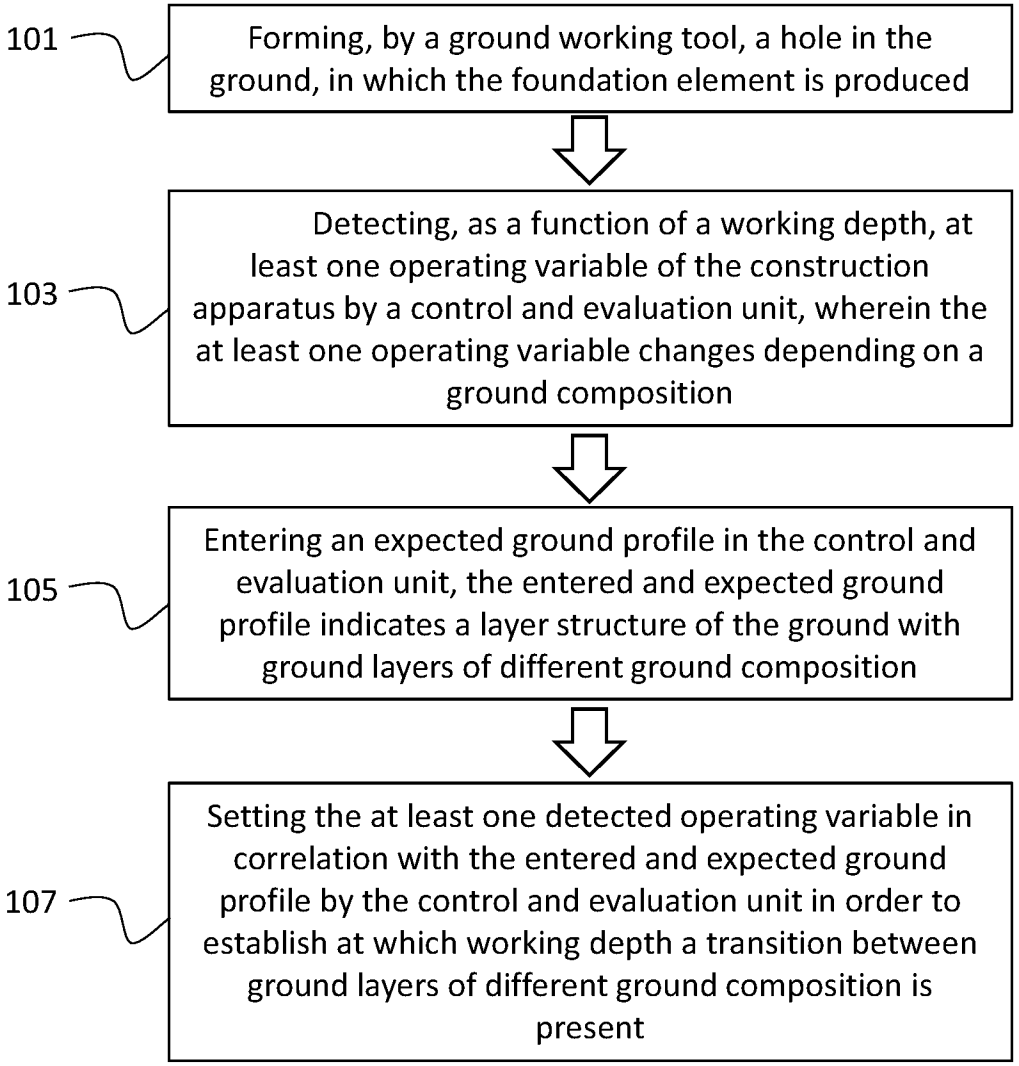
Forming, by a ground working tool, a hole in the ground, in which the foundation element is produced
101
Detecting, as a function of a working depth, at least one operating variable of the construction apparatus by a control and evaluation unit, wherein the at least one operating variable changes depending on a ground composition
103
Entering an expected ground profile in the control and evaluation unit, the entered and expected ground profile indicates a layer structure of the ground with ground layers of different ground composition
105
Setting the at least one detected operating variable in correlation with the entered and expected ground profile by the control and evaluation unit in order to establish at which working depth a transition between ground layers of different ground composition is present
107

METHOD AND SYSTEM FOR PRODUCING A FOUNDATION ELEMENT IN THE GROUND

The invention relates to a method for producing a foundation element in the ground by means of a construction apparatus, wherein by means of a ground working tool a hole is formed in the ground, in which the foundation element is produced, wherein by means of a control and evaluation unit at least one operating variable of the construction apparatus, which changes depending on a ground composition, is detected as a function of a working depth, in accordance with the preamble of claim 1.

The invention further relates to a system for producing a foundation element in the ground with a construction apparatus, wherein by means of a ground working tool a hole is formed in the ground, in which the foundation element is produced, wherein by means of a control and evaluation unit at least one operating variable of the construction apparatus, which changes depending on a ground composition, is detected as a function of a working depth, in accordance with the preamble of claim 12.

When producing foundation elements, such as foundation piles or diaphragm walls, in larger construction projects it is common practice to create a ground profile for the building ground. The ground profile indicates which structure, in particular layer structure, the building ground has. A knowledge of the ground profile of the building ground is important in several respects. On the one hand, the load-bearing capacity of the building ground depends on the ground profile, which has a significant impact on the construction of the foundation elements. On the other hand, the ground profile is also of relevance from an economic viewpoint since the structure of the ground determines how laborious the production of a foundation element is. For instance, the production of a bored pile in a building ground having a large proportion of rock material proves to be more laborious due to slower advancement and the higher tool wear as compared to the production of a bored pile in a building ground having layers of sand, gravel and/or clay.

For this reason, one or several test drillings are carried out on a building ground depending on the size in order to ascertain on the basis of drill cores for example, which ground profile the building ground is composed of.

However, depending on the geology of the building ground a ground profile can vary considerably even in a locally limited area. Usually, these variations reside in the occurrence of thickness changes of the individual ground layers and, as the case may be, also in a change of a rock horizon.

From EP 1 942 247 B1 a method for displacement drilling is known, in which the torque and the penetration depth of the drill string are measured per rotation during operation in order to make an assessment on the load-bearing capacity of the ground. The document teaches that the load-bearing capacity is determined by previously carrying out test drillings in ground layers with known properties so that by means of an assignment rule a load-bearing capacity key figure can be assigned to the measured operating parameters. In the practice a precise assignment of a measured operating parameter to a specific load-bearing capacity can be problematic and prone to errors.

The invention is based on the object to provide a method and a system for producing a foundation element in the ground, with which a layer structure of the ground can be ascertained with particular precision for a foundation element.

In accordance with the invention the object is achieved on the one hand by a method having the features of claim 1 and on the other hand by a system having the features of claim 12. Preferred embodiments of the invention are stated in the dependent claims.

The method according to the invention is characterized in that in the control and evaluation unit a ground profile to be expected is entered, which indicates a layer structure of the ground with ground layers of different ground composition, and in that by the control and evaluation unit the detected, at least one operating variable is set in correlation with the entered ground profile in order to establish, at which working depth a transition between ground layers of different ground composition is present.

BRIEF DESCRIPTION OF THE DRAWING

FIG. 1 shows a flowchart of steps for a method for producing a foundation element in the ground by a construction apparatus in accordance with an exemplary embodiment.

FIG. 1 shows by way of a flowchart, an example of a method for producing a foundation element in the ground by a construction apparatus. The method includes forming, by a ground working tool, a hole in the ground, in which the foundation element is produced (step 101). The method further includes detecting, as a function of a working depth, at least one operating variable of the construction apparatus by a control and evaluation unit, wherein the at least one operating variable changes depending on a ground composition (step 103). The method includes entering an expected ground profile in the control and evaluation unit, wherein the entered and expected ground profile indicates a layer structure of the ground with ground layers of different ground composition (step 105). Further, the method includes setting the at least one detected operating variable in correlation with the entered and expected ground profile by the control and evaluation unit in order to establish at which working depth a transition between ground layers of different ground composition is present (step 107).

A basic idea of the invention resides in the fact that when determining the type of ground during the working of ground a ground profile created for the building ground is taken into account. A ground profile created beforehand indicates the sequence of various ground layers consisting of different materials and possessing different strengths and load-bearing capacities. Here, the invention is based on the finding that a ground profile on a building ground can be subject to strong local variations, in which case these variations, however substantially relate to a thickness or a depth level of the ground layers while the number and sequence of the ground layers remains unchanged. According to the invention, when working the ground an operating variable or an operating parameter is detected which can be the torque or power of the hydraulic drive for example. This operating variable is set in a correlation with the first ground layer of the ground profile. If a significant change of the operating variable is then established at a specific first working depth, so according to the finding of the invention this is ascribed to a change of the ground layer. This change at a first working depth can then be established as a first layer transition. In the case of corresponding subsequent changes, the second, third and subsequent layer transitions can then be established accordingly at a given working depth.

Thus, for the production of a special foundation element the ground profile actually present at the production site can be established, in which case the individual layer transitions at predetermined depths may differ from the previously ascertained ground profile. Usually, the previously ascertained ground profile is ascertained by way of one or several test drillings at specific places, whereupon from this an average ground profile is ascertained. By specially establishing an actual ground profile at each working location a reliable assessment can be made as to the load-bearing capacity of the foundation element and also as to the expenditure actually necessary for the production of the foundation element. This also permits an especially correct and expenditure-based calculation and invoicing of a foundation element depending on the ground conditions actually present.

According to a further development of the invention it is particularly expedient that by the control and evaluation unit a value to be expected of the at least one operating variable is ascertained for each ground layer of the entered ground profile. For instance, if the ground profile first shows a clay layer and then a gravel layer, the control and evaluation unit can query a value e.g. from a database that is to be expected in this ground layer with regard to the operating variable to be measured. The control and evaluation unit can also verify so that a ground layer actually worked on conforms to the ground layer to be expected according to the predetermined ground profile. This also allows the ascertainment of special cases in which, at a working location, one or several ground layers is or are not present in comparison to the entered target ground profile.

According to another preferred method variant provision is made in that by the control and evaluation unit a current ground profile is created for the working location. This current or actual ground profile can then be saved and also compared with the predetermined target ground profile that has been ascertained beforehand by way of test drillings. The operator is thereby given the possibility to predetermine the current ground profile thus created as target ground profile for the next upcoming working process.

Basically, according to the invention only a single operating variable or a single operating parameter can be used to determine the ground layer currently worked on. According to a further development of the method pursuant to the invention it is especially advantageous that several operating variables are detected and that the several operating variables are set in correlation with one another, wherein a ground characteristic value is ascertained for the control and evaluation unit. For example, not only the torque of a drilling tool but also an advancement speed present at a predetermined advancement force can thus be detected as operating variable. In particular, by combining the torque or a rotational speed with an advancement speed or an advancement force an still better assessment as to the composition of a ground layer to be worked on can be made. From this a ground characteristic value can be ascertained which, based on values saved in a database, can be assigned to a specific ground type or ground layer.

For the detection of the relevant operating variables it is advantageous in accordance with a further development of the invention that the at least one operating variable is detected by means of at least one detection means on the construction apparatus. In particular, the detection means can be a sensor that directly detects an operating variable, such as the rotational speed. The detection means can also operate indirectly, in which case e.g. a torque is calculated and determined on the basis of the power consumption of a hydraulic rotary drive. The detection means are connected via a wire or radio connection to the control and evaluation unit. The control and evaluation unit can be located directly on the construction apparatus or in a center which then has a data link to the construction apparatus via a corresponding connection.

Basically, any suitable operating variable or operating parameter can be selected and used for the method according to the invention. According to a further development of the method pursuant to the invention it is particularly meaningful that the at least one operating variable is selected from the variables of torque, rotational speed, power, feed force, feed speed, acceleration, energy input, vibrations, sound, hydraulic pressure and/or hydraulic flow. In particular, a combination of several operating variables can also be selected so that an assessment with an especially high certainty as to the ground layer currently worked on can be made by the control and evaluation unit.

According to another advantageous method variant of the invention provision is made in that the control and evaluation unit has a database, in which operating variables and/or ground characteristic values are saved for specific ground layers. The database can already be preset at the time of delivery of a construction apparatus or during operation it can be installed from a center or provided and maintained with new or supplementary values. Furthermore, according to a variant of the invention it is possible that on the part of the operator or by the control and evaluation unit itself preferred datasets, i.e. preferred input variables for specific ground characteristic vales are saved, which have been created and ascertained for the respective working location or for the respective apparatus. The database can thus constitute an expert system, in which case provision can also be made for an automatic improvement and alteration of the stored datasets due to a preferred self-learning logic of the control and evaluation unit.

Another preferred embodiment of the invention resides in the fact that for ascertained operating variables, ground characteristic values saved for specific operating variables are queried and compared by the control and evaluation unit, wherein a current ground value is determined. For instance, if the control and evaluation unit recognizes, by comparing the input variable, e.g. the torque, with a resultant output variable, i.e. a resulting rotational speed of the drilling tool or the cutting wheel, that a ground layer of altered strength and therefore with a different ground working value is penetrated, the control and evaluation unit can change the input variables according to the currently ascertained ground characteristic value or the currently established ground layer. Thus, for example, if a layer of rock is established the rotational speed and the feed force can be reduced to prevent an excessive tool wear and provide cutting and stripping conditions as optimally as possible for the ground layer. If a dataset with an identical or a similar ground characteristic value is ascertained in the database, the control and evaluation unit can change the input or operating variable according to the established dataset or display this to the machine operator on a monitor for example. In an automatic mode the previous operating variable can be replaced by a suitable operating variable for the ground characteristic value. Hence, in this case an applied torque would be changed depending on the established ground characteristic value, which is assigned to a specific ground layer, following evaluation of the database.

Especially when penetrating a ground with various ground layers it is of advantage in accordance with a method variant of the invention that on the basis of the ground characteristic values ascertained during the ground working and of the ground working values ascertained over the working depth or advancing section, a ground profile is ascertained and saved by the control and evaluation unit. According to data stored in the database a specific ground type, e.g. clay, sand, gravel, rock etc., can be assigned to a ground characteristic value, in which case this is preferably carried out by also taking the stored ground profile into account. Via a preferably existing remote data connection these values, and therefore also a ground profile, can be queried via the control and evaluation unit from a center. In this way, a construction apparatus can not only be used for working the ground but can also be employed as a probing or analysis tool to explore a ground profile.

According to a further embodiment of the method pursuant to the invention provision is made in that by the control and evaluation unit preferred operating variables for the current ground profile are ascertained over the working depth and stored as a dataset in the database. For example for a bore on a construction site a sample dataset can be created on the basis of the previously ascertained ground profile, in which case e.g. up to a first drilling depth a first torque and a first feed force are saved, subsequently at a second drilling depth, as from which a second ground layer is present, a second torque with a second feed force are saved and so on. Such a dataset for a ground having a specific ground profile can then be retrieved for a further working process on the same construction site. In this case, it can be assumed that on a construction site a ground profile only seldom changes by leaps and bounds. On the basis of the data of the first working process it is thus possible that the further working processes, in particular bores or trenches, can also be carried out effectively by less experienced machine operators.

Basically, the method according to the invention can be employed in various ground working variants. A particularly preferred method variant resides in the fact that as ground working, a drilling with a drilling tool or a cutting with a diaphragm wall cutter is carried out. The drilling process concerned can be a continuous drilling, e.g. using a continuous flight auger, or a discontinuous drilling, e.g. using a drilling bucket or a simple auger.

The method according to the invention can also be employed in the double-head drilling, in which at least two rotary drive units are provided. In this case, a first rotary drive unit can be provided for an internal drilling tool while a further rotary drive unit is arranged for an external drill pipe. Drilling in the ground also comprises rock drilling which can be carried out for instance in an anchor or HDI-drilling process in an approximately vertical wall or even in the ceiling area in a tunnel.

In the case of cutting, use is preferably made of a diaphragm wall cutter having at least one pair, by preference two pairs of cutting wheels driven in a rotating manner. The cutting of a cut trench concerned can be carried out in a single-phase, two-phase or a CSM® method, in which a soil mortar mixture is produced in-situ in the cut trench by the cutter. Provision can be made for one or several cutting wheel drives.

The invention further comprises a system or an installation for producing a foundation element in the ground which is characterized in that in the control and evaluation unit a ground profile to be expected can be entered which indicates a layer structure of the ground with ground layers of different ground composition, and in that by the control and evaluation unit the at least one detected operating variable can be set in correlation with the entered ground profile in order to establish, at which working depth a transition between ground layers of different ground composition is present.

The invention claimed is:

1. A method for producing a foundation element in the ground by a construction apparatus, the method comprising:

entering an expected ground profile in a database constituting an expert system of a control and evaluation unit, the entered and expected ground profile indicating a layer structure of the ground with ground layers of different ground composition, setting at least one operating variable based on the entered and expected ground profile by the expert system of the control and evaluation unit, drilling a hole in the ground with a drilling tool of a rotary drilling apparatus or cutting a hole in the ground with a diaphragm wall cutter, in which the foundation element is produced, and detecting, as a function of a working depth, a change in the at least one operating variable of the construction apparatus by the control and evaluation unit, wherein the detected change of the at least one operating variable represents a current layer transition between the ground layers of the different ground composition.

2. The method according to claim 1,
including:
ascertaining a value to be expected of the at least one operating variable for each ground layer of the entered and expected ground profile by the control and evaluation unit.

3. The method according to claim 1,
including:
creating a current ground profile for a working location by the control and evaluation unit.

4. The method according to claim 1,
including:
detecting several operating variables, and
setting the several operating variables in a correlation with one another, wherein, the control and evaluation unit ascertains a ground characteristic value.

5. The method according claim 1,
including:
detecting the at least one operating variable by a detector on the construction apparatus.

6. The method according to claim 1,
wherein
the at least one operating variable is selected from variables torque, rotational speed, power, feed force, feed speed, acceleration, energy input, vibrations, sound, hydraulic pressure and/or hydraulic flow.

7. The method according to claim 1,
wherein
the database, in which operating variables and/or ground characteristic values are saved for specific ground layers.

8. The method according to claim 1,
wherein
for ascertained operating variables, ground characteristic values saved for specific operating variables are queried and compared by the control and evaluation unit, wherein a current ground characteristic value is determined.

9. The method according to claim 1,
wherein
on the basis of ground characteristic values ascertained during ground working a current ground profile is ascertained and saved by the control and evaluation unit.

10. The method according to claim 1, including:

ascertaining preferred operating variables for a current ground profile over the working depth and storing as a dataset in the database by the control and evaluation unit.

11. A system for producing the foundation element in the ground with the construction apparatus, wherein the system is designed to carry out the method according to claim 1.

12. The method according to claim 1, wherein the at least one operating variable is a variable speed of insertion and a variable torque.

13. The method according to claim 12, wherein the variable speed of insertion and the variable torque are compared to operating variable and/or ground characteristic values saved for specific ground layers, and a specific ground type is identified from the variable speed of insertion and the variable torque.

14. A method for producing a foundation element in the ground by a construction apparatus, the method comprising:

entering an expected ground profile in a database constituting an expert system of a control and evaluation unit, the expected ground profile indicating a layer structure of the ground, the layer structure including at least a first ground layer and a second ground layer, wherein a first ground composition of the first ground layer is different from a second ground composition of the second ground layer and an expected transition change is present between the first and second ground layers;

setting at least one operating variable of the construction apparatus based on the expected ground profile for at least the first ground layer by the expert system of the control and evaluation unit;

generating a hole in the ground in which the foundation element is produced with the construction apparatus selected from a rotary drilling apparatus or a diaphragm wall cutter;

during the generating of the hole, detecting a change in the at least one operating variable of the construction apparatus by the control and evaluation unit, wherein the change in the at least one operating variable reflects an actual transition change between the first ground layer and the second ground layer, wherein the actual transition change is different from the expected transition change; and updating the database with an actual ground profile including at least an established working depth at which the actual transition change between the first and second ground layers occurs.

* * * * *